US006565131B2

(12) United States Patent
Roos

(10) Patent No.: US 6,565,131 B2
(45) Date of Patent: May 20, 2003

(54) POWER-ASSISTED CLOSING DEVICE

(75) Inventor: Martin Roos, Oestrich-Winkel (DE)

(73) Assignee: Mannesmann VDO AG, Frankfurt (DE)

( * ) Notice: Subject to any disclaimer, the term of this patent is extended or adjusted under 35 U.S.C. 154(b) by 0 days.

(21) Appl. No.: 09/802,514

(22) Filed: Mar. 8, 2001

(65) Prior Publication Data

US 2001/0010427 A1 Aug. 2, 2001

Related U.S. Application Data

(63) Continuation of application No. 09/337,111, filed on Jun. 21, 1999, now abandoned.

(30) Foreign Application Priority Data

Jun. 24, 1998 (DE) ..... 198 28 040

(51) Int. Cl.[7] ..... E05C 3/06
(52) U.S. Cl. ..... 292/201; 292/216
(58) Field of Search ..... 292/201, 216, 292/DIG. 42; 70/280, 282

(56) References Cited

U.S. PATENT DOCUMENTS

| | | | | | |
|---|---|---|---|---|---|
| 4,395,064 | A | * | 7/1983 | Bellot | 292/201 |
| 5,007,261 | A | * | 4/1991 | Quantz | 70/240 |
| 5,020,838 | A | * | 6/1991 | Fukumoto | 292/201 |
| 5,411,302 | A | * | 5/1995 | Shimada | 292/201 |
| 5,423,582 | A | * | 6/1995 | Kleefeldt | 292/201 |
| 5,433,496 | A | * | 7/1995 | Zimmermann | 292/201 |
| 5,642,636 | A | * | 7/1997 | Mitsui | 70/237 |
| 5,769,468 | A | * | 6/1998 | Armbruster | 292/201 |
| 5,876,074 | A | * | 3/1999 | Dowling | 292/201 |
| 6,019,402 | A | * | 2/2000 | Arabia | 292/216 |

FOREIGN PATENT DOCUMENTS

| | | |
|---|---|---|
| DE | 3708095 | 4/1988 |
| DE | 9012785 | 1/1991 |
| DE | 19505779 | 8/1996 |
| DE | 19614122 | 10/1997 |
| DE | 19632781 | 2/1998 |
| DE | 19650661 | 6/1998 |
| DE | 19725416 | 1/1999 |

* cited by examiner

*Primary Examiner*—Gary Estremsky
(74) *Attorney, Agent, or Firm*—Martin A. Farber

(57) ABSTRACT

A power-assisted closing device (1) for doors, flaps, folding tops or roofs of vehicles, in particular passengers cars, having a pivotably mounted rotary latch (2) which interacts with a fastening peg, a detent pawl (7) which releasably locks the rotary latch (2), and an actuating drive which acts via a disk cam (13) on the rotary latch (2) and the detent pawl (7) to effect an unlocking or locking procedure, wherein a pivotable stop element (17) is arranged on the rotary latch (2) and a pivotable stop element (20) is arranged on the detent pawl (7), the stop element (17, 20) interacting with the disk cam (13) in the unlocking or locking procedure.

12 Claims, 9 Drawing Sheets

POWER-ASSISTED CLOSING DEVICE

RELATED APPLICATION

This is a continuation application of my copending application (including a CPA Application) Ser. No. 09/337,111 filed Jun. 21, 1999 under 35 USC 120 now abandoned.

FIELD AND BACKGROUND OF THE INVENTION

The invention relates to a power-assisted closing device for doors, flaps, folding tops or roofs of vehicles, in particular passenger cars, in accordance with the features of the preamble of patent claim 1.

DE 37 08 095 A1 discloses a power-assisted lock for doors, flaps, folding tops or roofs on vehicles, which has a pivotably mounted rotary latch which interacts with a fastening peg, it being possible for the rotary latch to be releasably locked by a detent pawl and furthermore for it to be able to be driven to effect an unlocking or locking procedure by a power-dispensing member.

Furthermore, a functional disk having at least one latching projection for the detent pawl in the unlocking position of the lock and a bevel for releasing the detent pawl from the latching position into the switching position is mounted pivotably next to the rotary latch. Moreover, the rotary latch is likewise provided in the opposite direction of rotation with a latching projection and a bevel each having the same function, and a hydraulic cylinder is coupled to the functional disk, the functional disk having a play-afflicted drive-type connection to the rotary latch. The rapidly advancing rotation of the rotary latch, which is caused by the fastening peg during the locking, unlocks the functional disk, the rapidly advancing rotation of the functional disk, which is caused by the return of the hydraulic cylinder or is manually triggered, unlocking the rotary latch during unlocking.

Although a design of this type has been proven with regard to good reliability, the complex form of the rotary latch and the detent pawl, but also of the functional disk with its associated bevels and slots in which the hydraulic cylinder engages, results in a costly construction. Moreover, during the installation of the power-assisted lock the position of the functional disk with the hydraulic cylinder coupled thereto has to be brought into a defined position with regard both to the detent pawl and also to the rotary latch so that the sloping surfaces of the functional disk can come into operative connection with the associated sloping surfaces of the detent pawl or of the rotary latch. This means that the outlay on installation is increased.

SUMMARY OF THE INVENTION

The invention is therefore based on the object of providing a power-assisted closing device which in addition to the required, utmost reliability is also distinguished by a simple construction and ease of installation. The aim with this power-assisted closing device is to open and close the doors, flaps, folding tops or roofs of vehicles in a power-assisted manner or else automatically.

According to the invention, provision is made for a respective stop element to be pivotably mounted on the rotary latch and on the detent pawl, the stop elements interacting with the disk cam, which is driven by an actuating drive, in the opening procedure (in other words: unlocking procedure) or in the closing procedure (in other words: locking procedure). That means that in the unlocking procedure the stop element on the detent pawl is effective for opening (unlocking) the rotary latch, while the stop element on the rotary latch is ineffective and hence pivoted away in this case. On the other hand, in the locking procedure it is such that the stop element which is arranged on the rotary latch is effective so that by the latter the actuating drive can drive the rotary latch and lock the closing device. In this case, the stop element which is arranged on the detent pawl is ineffective. This arrangement ensures that the pivotable stop elements can be installed on the rotary latch and on the detent pawl, the detent pawl and the rotary latch being rotably mounted in a housing of the closing device. The assignment of the rotary disk cam to the detent pawl and the rotary latch results in installation being easy and rapid without attention having to be paid during the installation as to the position in which the disk cam has to be aligned with regard to the detent pawl or the rotary latch.

In a development of the invention, a restoring spring is assigned to a respective stop element. This ensures in a simple manner that the respectively appropriate stop element is effective or ineffective in the unlocking procedure or in the locking procedure. In the ineffective case, the stop element is rendered ineffective by the force of the restoring spring being overcome. In the effective case, the stop element bears by means of a form fit against the relevant counter part (rotary latch or detent pawl), with the result that the actuating drive can act via the disk cam on this counter part for unlocking or locking.

In a development of the invention, the disk cam has a peg which acts on the stop elements. The installation is further improved by this refinement, in particular by a peg protruding perpendicularly from the surface of the disk cam, a further advantage which can be mentioned being the flat construction. Installation is therefore made easy since the disk cam is pushed, for example, onto a peg of a housing half shell and further pegs are provided on the housing half shell to receive the detent pawl and the rotary latch. In the process, attention does not have to be paid to a certain position when fitting the elements and so malfunctions caused by erroneously installed elements are also avoided during initial operation.

In a development of the invention, the rotary latch can be driven in a geared-down manner by the actuating drive, this being required in order to overcome the forces when shutting the door (for example, triggered by the weight of the door or else the sealing forces).

In a development of the invention, the actuating drive is an electric motor which drives the disk cam in a geared-down manner. The advantageous result of this is a compact constructional unit.

In a development of the invention, for the locking procedure the actuating drive acts via the disk cam on the stop element of the rotary latch and for the unlocking procedure on the stop element of the detent pawl. That is to say that depending on the type of procedure only the one stop element is subjected to force and thus a function which is required for this desired procedure is triggered. In addition, it is thereby ensured that also only the desired procedure is triggered when the actuating drive is activated. Thus, for example in the locking procedure, i.e. when the rotary latch is being rotated and thus when the door is being shut, the detent pawl cannot be operated since if this was operated it would result in the locking procedure being terminated or prevented. The same happens in the unlocking procedure so that it is ensured that when, the detent pawl is driven to the effect of providing opening assistance, the door cannot be shut again onto the rotary latch by being subjected to force. This is thus a very important safety aspect.

In a development of the invention, the rotary latch has a preliminary catch which interacts with the detent pawl and a main catch, means being provided which detect at least the preliminary catch position of the rotary latch. This ensures that an operator brings the door, the rear flap or the trunk lid, for example, from the opened position into the so called preliminary catch position, the fastening peg, which is arranged on the door, the rear flap or the trunk lid, being intercepted by the rotary latch and held in a preliminary closing position. It should further be noted here that the fastening peg can also be arranged on a vehicle part which is secured to the body and the power-assisted closing device with the rotary latch, detent pawl, disk cam and actuating drive can be arranged in the door or the like.

As soon as the door or the like is brought into the preliminary closing position, this is recognized by the means and the actuating drive for the locking procedure (shutting assistance) is activated. As an alternative to the means which detect the preliminary catch position of the rotary latch, means can also be provided which detect the preliminary closing position of the door or the like per se. In a development of the invention, the means comprise a preliminary catch switch which can be operated by the rotary latch or the stop element thereof and optionally a main-catch switch which can be operated by the detent pawl. Means for detecting the position and on which the activation of the actuating drive depends can thereby be integrated in the immediate vicinity of the elements of the closing device, in particular can be integrated therewith in a housing. The outlay on cabling is thus also reduced as long as these switches (or other means in general) are accommodated in the housing together with the actuating drive and a control device which has yet to be described.

In a development of the invention, the actuating drive, in particular of the electric motor, can be operated in block mode. That means that the actuating drive is activated and drives the disk cam until the latter runs, in particular with its peg, onto the stop element which acts in a positively locking manner with the rotary latch or with the detent pawl, specifically in a manner such that further driving of the disk cam is no longer possible. This can be evaluated in a suitable manner (for example, by evaluating the increase in power of the actuating drive) and the actuating drive can be switched off as a result. Means for positional control (for example, microswitches, restoring springs or other means) can thus be dispensed with, as a result of which the installation is again simplified and the number of elements reduced.

In a development of the invention, the pivotably mounted detent pawl is subjected to force in the direction of the rotary latch, it thereby being ensured that after the detent pawl has been pivoted by the disk cam out of the operative range of the rotary latch, the detent pawl itself can again enter into operative connection with the rotary latch (for locking).

BRIEF DESCRIPTION OF THE DRAWINGS

One possible constructional refinement of the closing device, to which the invention is not, however, restricted, is described in the following and explained with reference to the figures.

The figures show the following.

DETAILED DESCRIPTION OF THE PREFERRED EMBODIMENT

Figure 1:
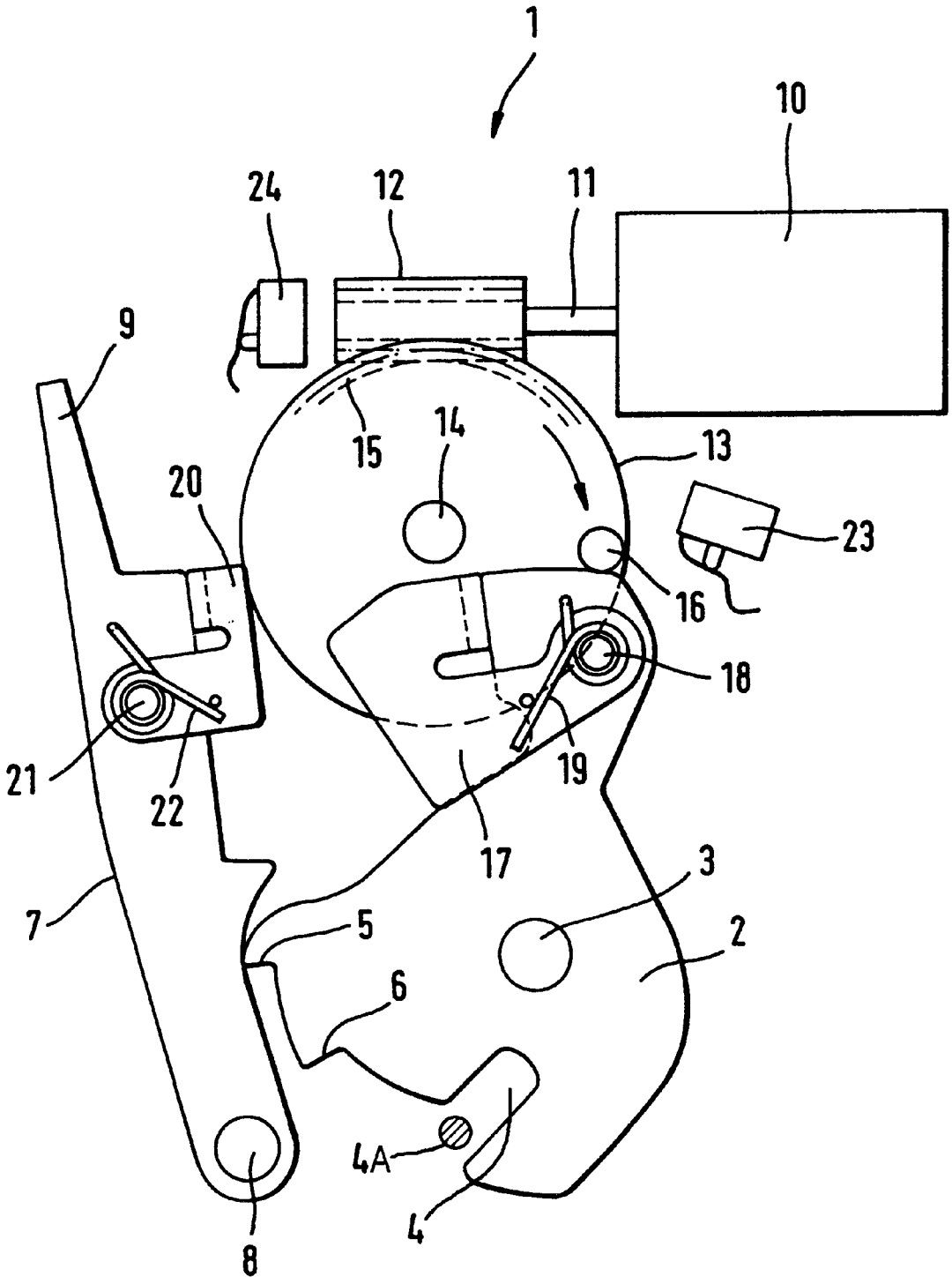
FIGS. 1 to 9: a power-assisted closing device in the various functional positions.

FIGS. 1 to 9 show the various functional positions of a power-assisted closing device 1, only the elements of the power-assisted closing device 1 being enumerated and described with reference to FIG. 1 for the time being.

The power-assisted closing device 1 has a rotary latch 2, the rotary latch 2 being mounted such that it can rotate about a pivot 3. This pivot 3 can be realized, for example, as a peg which protrudes from a housing, in particular from a housing half shell. The rotary latch 2 furthermore has a recess 4 into which a fastening peg 4A can be introduced and after it has been introduced can be held immovably, this position corresponding to a closing position of the door or the like. In the opening position the fastening peg can slide out of the recess 4. The rotary latch 2 furthermore has a preliminary catch 5 and a main catch 6 which are designed as projections of the rotary latch 2 and interact with a corresponding counter projection on a detent pawl 7. The detent pawl 7, which is designed as a separate component, is likewise mounted such that it can rotate about a pivot 8 which is designed in the same manner as the pivot 3. FIG. 1 shows that the detent pawl 7 has an extension 9 which will be gone into a more detail below.

The power-assisted closing device 1 furthermore has as actuating drive an electric motor 10 which bears a worm 12 on its motor shaft 11, the worm 12 being arranged rotably on the motor shaft 11 by being pressed on, for example.

The power-assisted closing device 1 furthermore also has a disk cam 13 which is mounted such that it can rotate about a pivot 14. The disk cam 13 is of flat design and over its entire circumference has a worm thread 15 which meshes with the worm 12. It is thus possible for the disk cam 13 to be driven by the electric motor 10 via the worm 12 and the worm thread 15 in a geared-down manner. The disk cam 13 has a peg 16, which is produced integrally with the disk cam 13 (as is the worm thread 15) or else is subsequently installed, protruding approximately perpendicularly from the disk cam 13 (i.e. from the plane of FIG. 1).

A pivotable stop element 17 is now arranged on the rotary latch 2, this pivotable stop element 17 being mounted such that it can rotate about a pivot 18 on the rotary latch 2. The pivotable stop element 17 is deflected from the position shown in FIG. 1 counter to the force of a restoring spring 19 by means of the peg 16. Depending on the position of the rotary latch 2 and rotational direction of the disk cam 13, the pivotable stop element 17 interacts with the rotary latch 2 in a positively locking manner to rotate the rotary latch 2 about the pivot 3, it being possible, however, for the pivotable stop element 17 also to be moved about the pivot 18 once the force of the restoring spring 19 has been overcome without pivoting the rotary latch itself.

In an analogous manner thereto, the detent pawl 7 has a pivotable stop element 20 which is mounted such that it can rotate about a pivot 21 on the detent pawl 7. In this case too the pivotable stop element can be pivoted counter to the force of a restoring spring 22 without the detent pawl 7 being deflected or is connected to the detent pawl 7 in a positively locking manner in such a way that the detent pawl 7 can be pivoted under the effect of the rotational movement of the peg 16 onto the pivotable stop element 20.

The power-assisted closing device 1 moreover also has a preliminary catch switch 23 which can be operated by the detent pawl 2 (or by the pivotable stop element 17), a main-catch switch 24 furthermore also being provided, which switch is arranged in such a manner that it can be operated by the extension 9 of the detent pawl 7 (or also by the pivotable stop element 20). While in FIG. 1 the rotary latch 2 is shown with a preliminary catch 5 and a main catch 6 and also with the associated preliminary catch switch 23 and the main-catch switch 24, the rotary latch 2 can also be designed with just a single catch.

In the following, the sequence of movement, i.e. a locking procedure (shutting) and an unlocking procedure (opening) is described with reference to FIGS. 1 to 9.

FIG. 1 shows the rotary latch 2 in an opened position, i.e. the door, the flap or the like is open. The electric motor 10 has been switched off since the peg 16 has moved to form a block against the pivotable stop elements 17 of the rotary latch 2. The motor is now switched off; neither the preliminary catch switch 23 or the main-catch switch 24 are operated.

Figure 2:
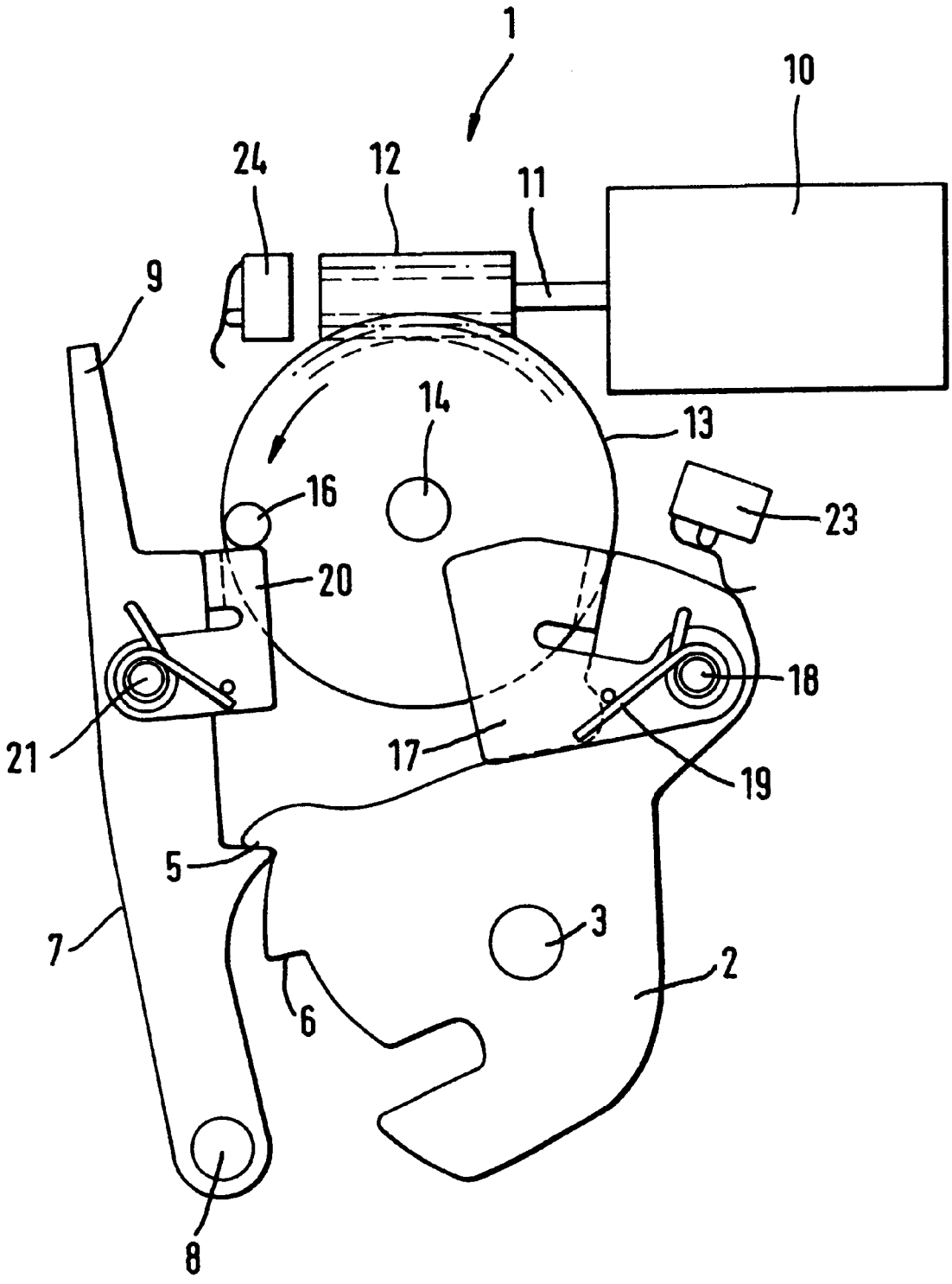

FIG. 2 shows that by the user moving the door the rotary latch 2 has been brought into the preliminary catch position so that the preliminary catch 5 has been arrested in this preliminary catch position by the corresponding projection on the detent pawl 7. At the same time, the pivotable stop element 17 or a corresponding extension on the rotary latch 2 thereby operates the preliminary catch switch 23 and activates the electric motor 10 which moves the disk cam 13 counterclockwise (when looking at FIG. 2). The peg 16 first reaches the pivotable stop element 20 of the detent pawl 7.

Figure 3:
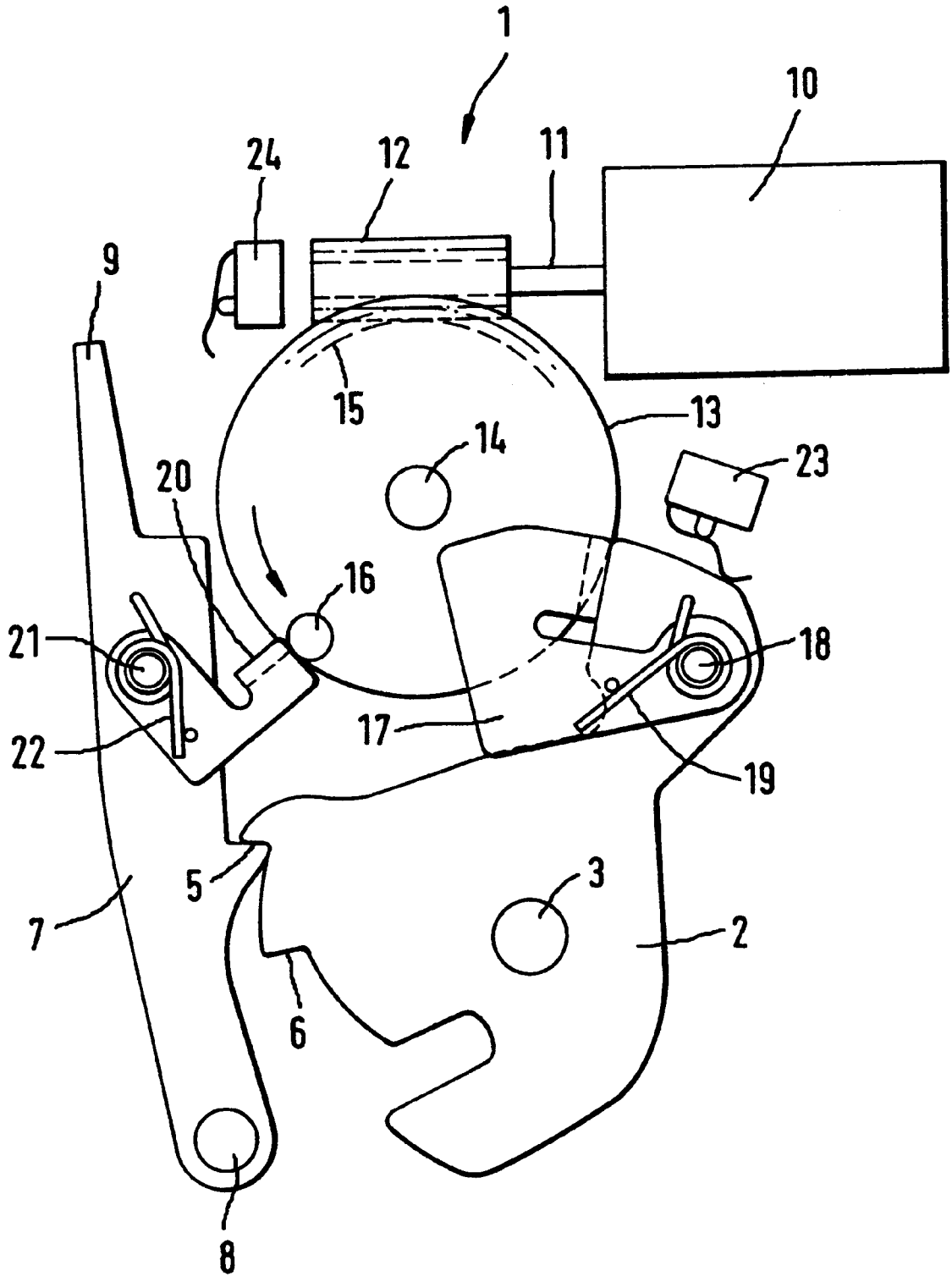

FIG. 3 now shows that on further rotation of the disk cam 13 the peg 16 deflects the pivotable stop element 20 of the detent pawl 7 counter to the force of the restoring spring without the detent pawl 7 itself being operated. As before, the preliminary catch switch 23 is operated so that the electric motor 10 is furthermore activated. The main-catch switch 24 is not operated yet.

Figure 4:
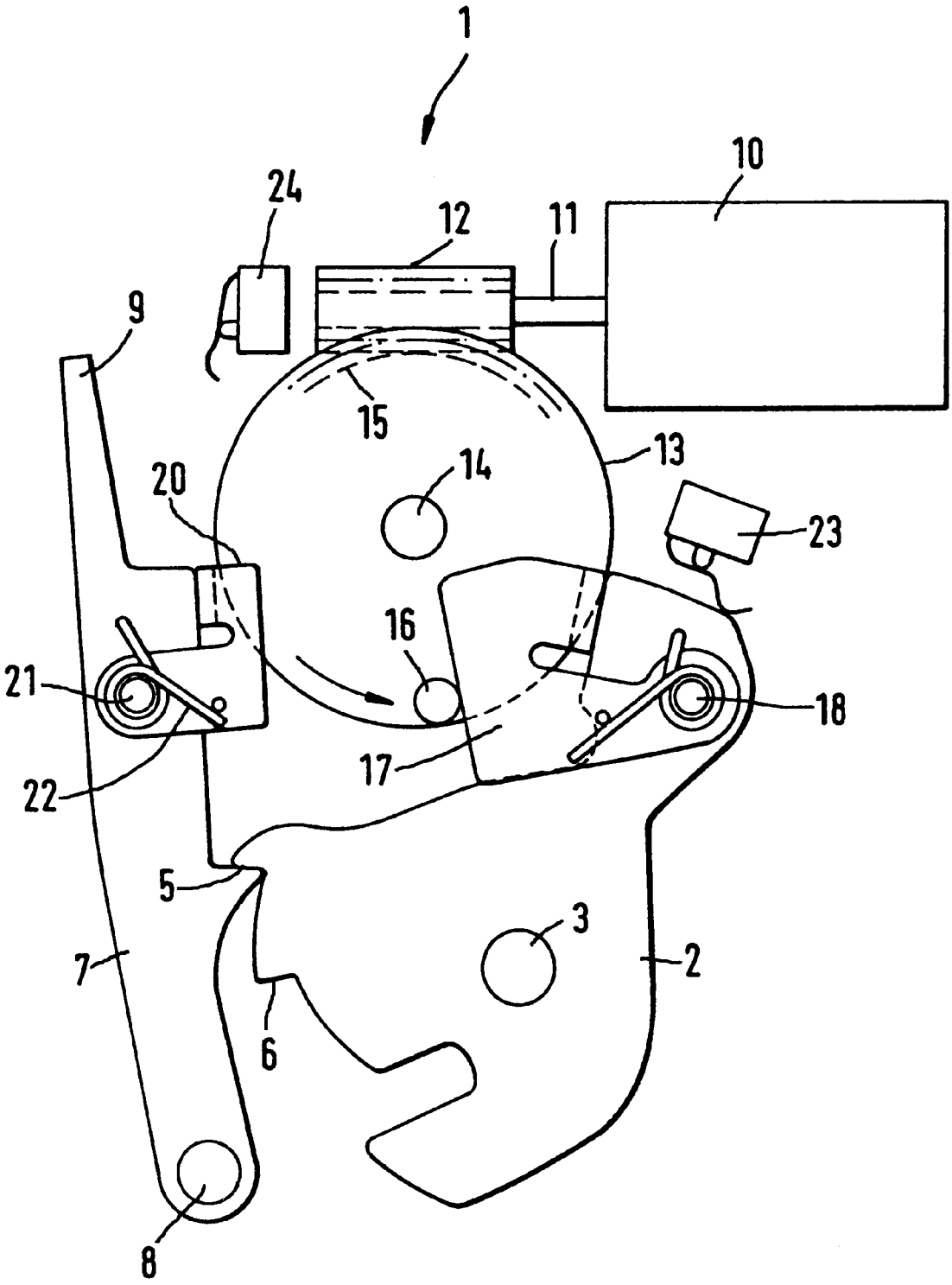

FIG. 4 shows that a further rotation of the disk cam 13 counterclockwise causes the peg 16 to strike against the pivotable stop element 17 of the rotary latch 2. The pivotable stop element 20 of the detent pawl 7 has in the meantime been pivoted back into its starting position because of the force of the restoring spring 22. The pivotable stop element 17 is in FIG. 4 in a position in which it is coupled in a positively locking manner to the rotary latch 2. As before, the preliminary catch switch 23 is operated while the main-catch switch 24 is as before inoperative. The rotary latch 2 is still in its preliminary closing position. Starting from the position of the peg 16 which is shown in FIG. 4, said peg by further rotation causes the rotary latch 2 to rotate clockwise about its pivot 3. As a result, the main catch 6 comes into operative connection with the projection on the detent pawl 7 so this further rotation causes the door or the like to be shut and likewise locked.

Figure 5:
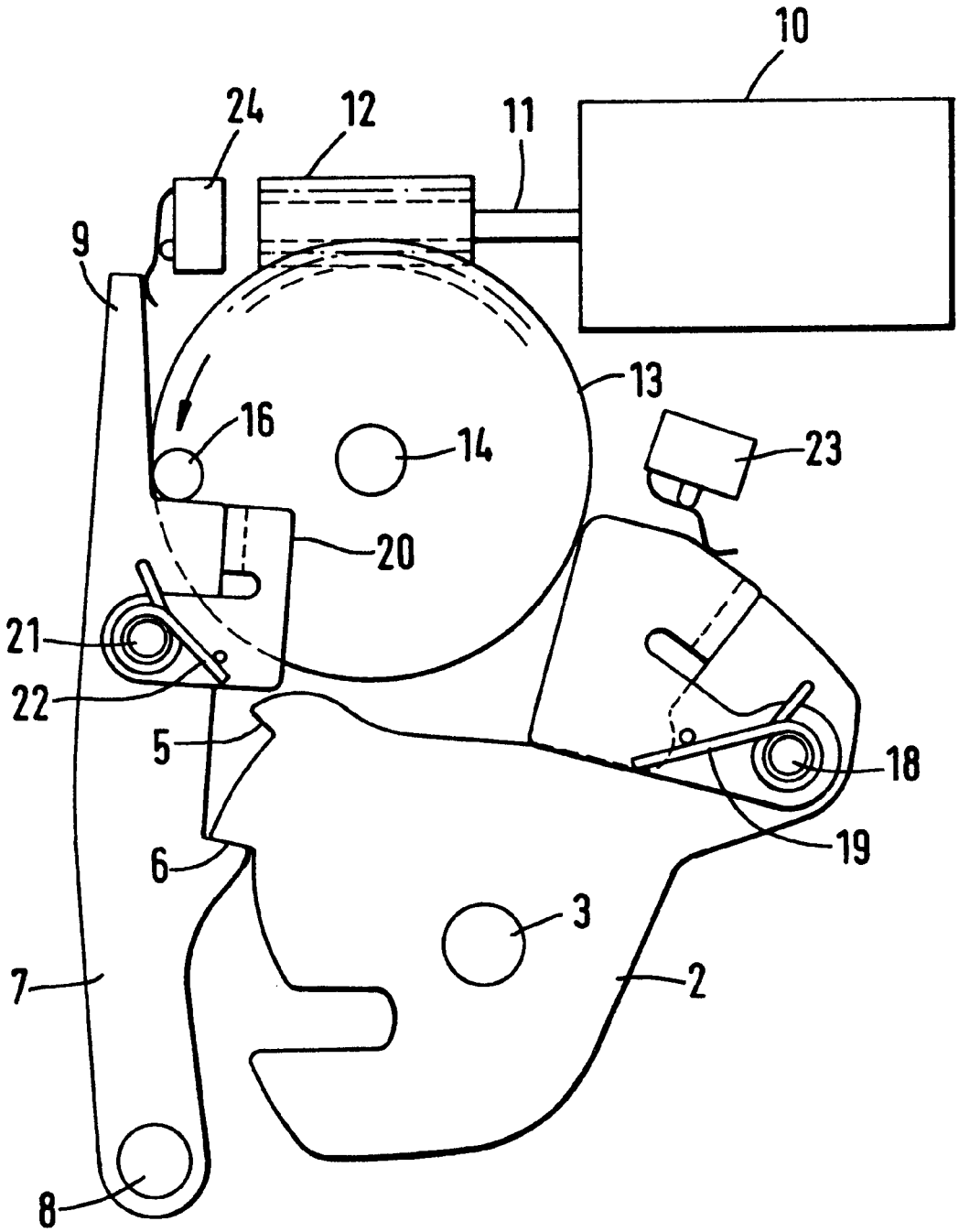

FIG. 5 now shows that the door is closed so that the rotary latch 2 is also in its arrested closing position. Since the preliminary catch switch 23 is, as before, operated and the electric motor 10 is, as before, activated, the peg 16 rotates further counterclockwise, specifically until it runs onto a block on the detent pawl 7. The electric motor 10 is switched off, either by the further movement of the peg 16 on the detent pawl, 7 being blocked and/or by the main-catch switch 24 being operated by the extension 9 on the detent pawl 7, and so the shutting procedure is thereby finished. The power-assisted closing device 1 is now in the rest state again. If the door or the like is then to be opened again, the following procedure is required.

Figure 6:
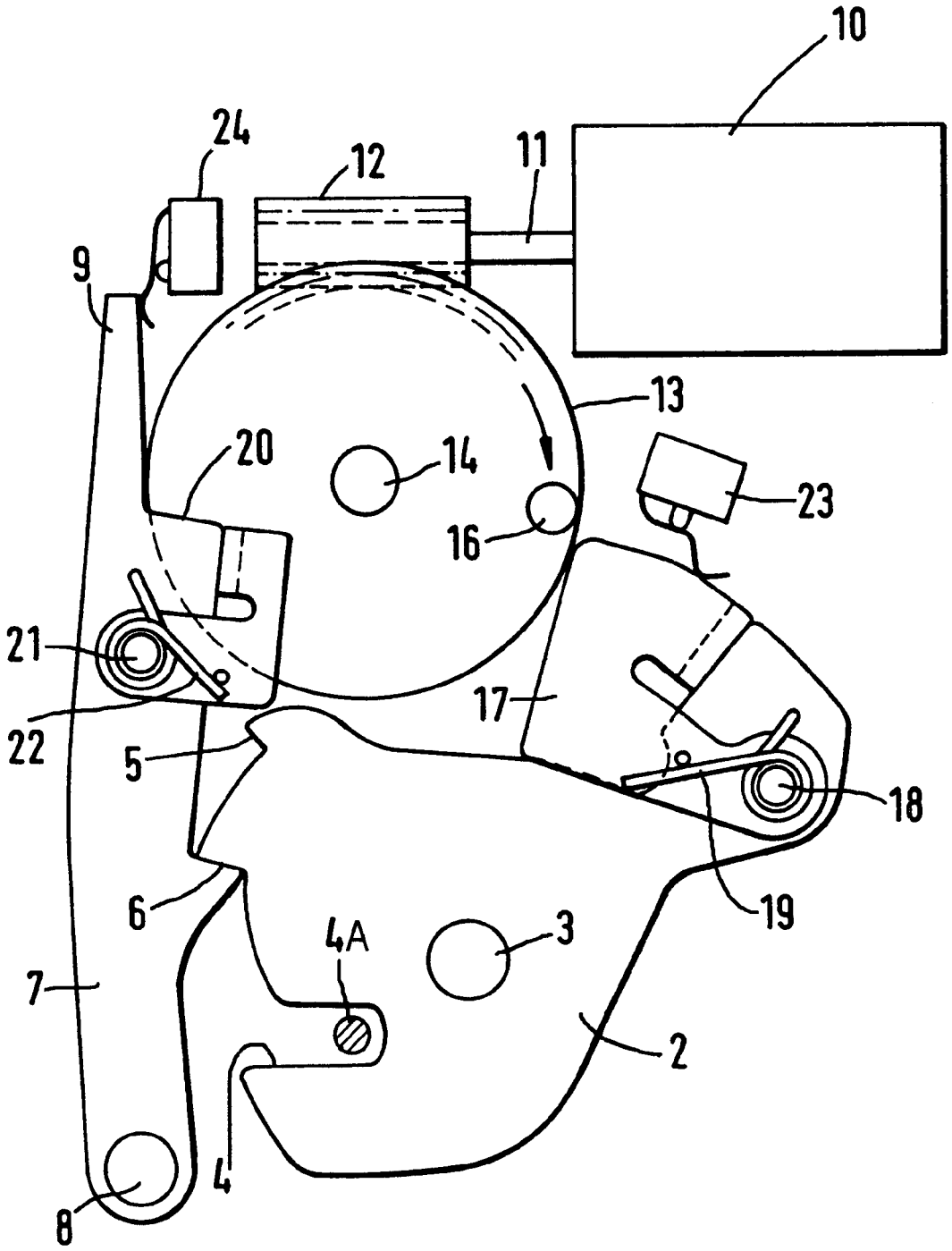

FIG. 6 shows that the peg 16 is moved, after the electric motor 10 is activated, in the counterclockwise direction from its rest position shown in FIG. 5, in precise terms past the pivotable stop element of the rotary latch 2. During this movement both the preliminary catch switch 23 and also the main-catch switch 24 are operated. On further rotation of the peg 16, said peg reaches the stop element 20, which is connected in this case in a positively locking manner to the detent pawl 7, with the result that further rotation of the peg 16 causes the detent pawl 7 to be deflected so that the projection on the detent pawl 7 can come into operative connection with the preliminary catch 5 of the rotary latch 2.

Figure 7:
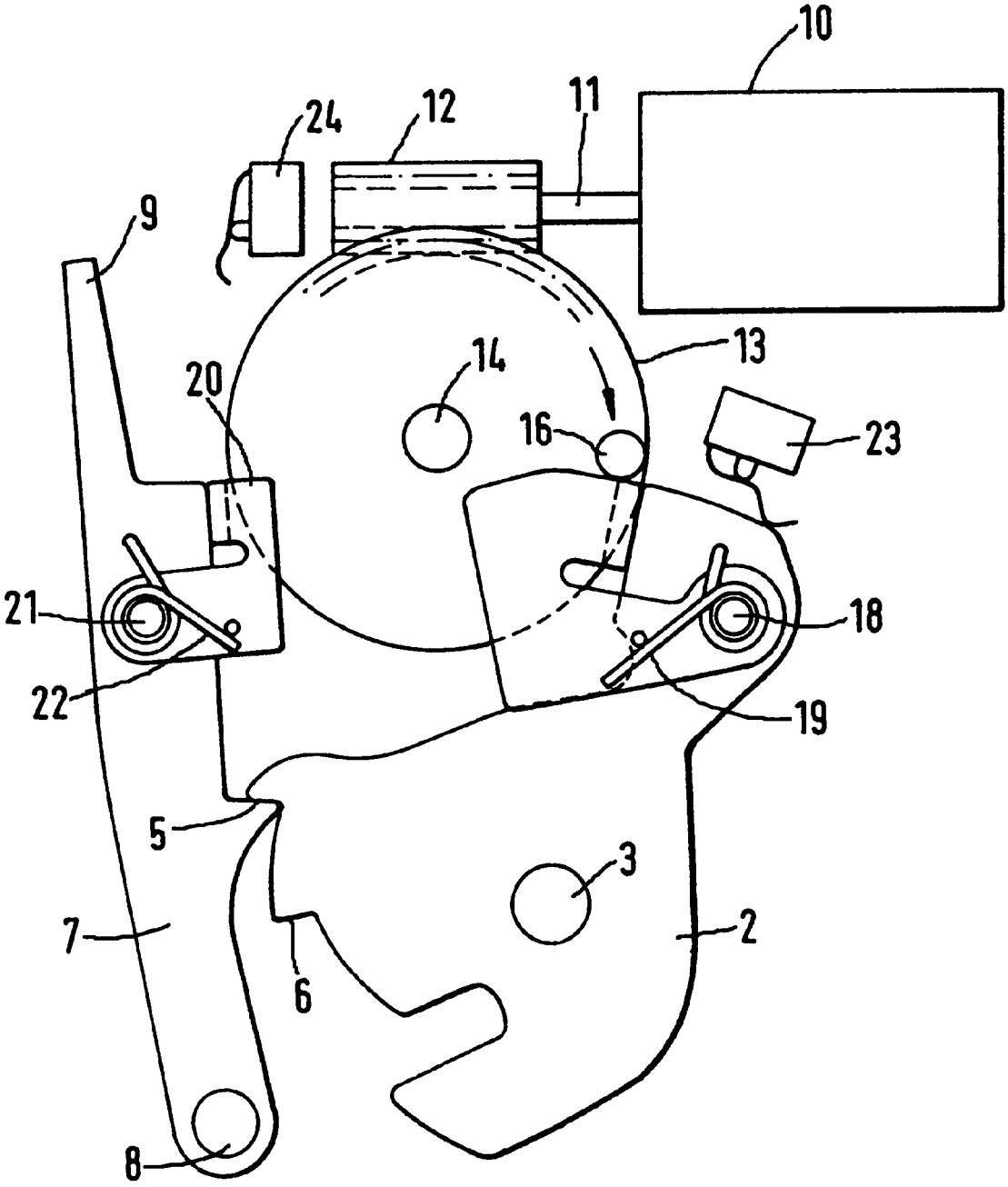
Figure 8:
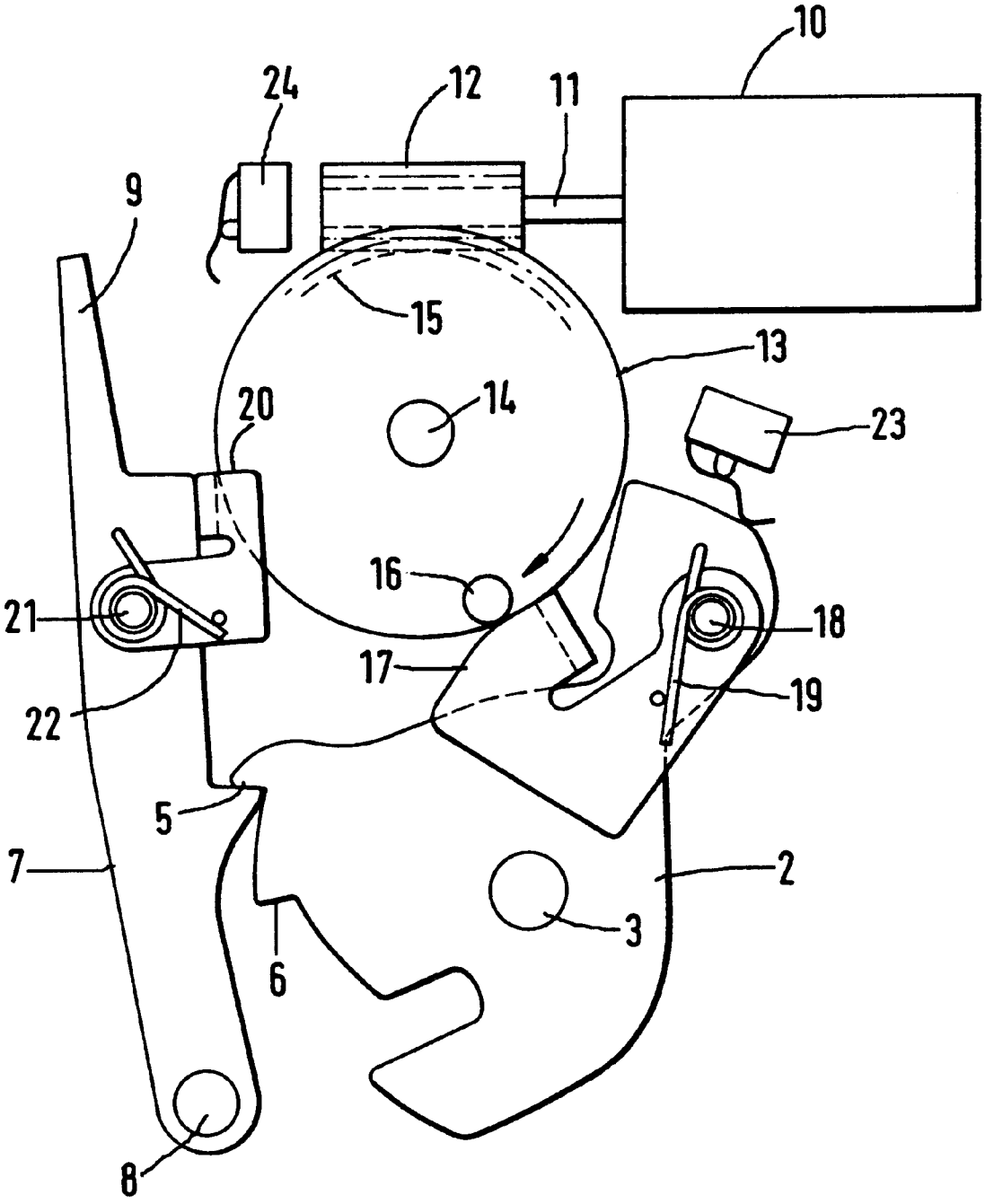

FIG. 7 shows this state of the projection of the detent pawl 7 being in operative connection with the preliminary catch 5. In this case, the preliminary catch switch 23 is, as before, operated while the main-catch switch 24 is inoperative. As before, the electric motor 10 remains activated so that the peg 16 is moved further in the clockwise direction until it reaches the pivotable stop element 17 of the rotary latch 2. FIG. 8 then shows that on further rotation of the peg 16, the latter deflects the pivotable stop element 17 counter to the force of the restoring spring 19 without in the process triggering an effect on the rotary latch 2; i.e., the rotary latch 2 further remains in the preliminary catch position. As before, the preliminary catch switch 23 is, operated while the main-catch switch 24 is, as before, inoperative.

Figure 9:
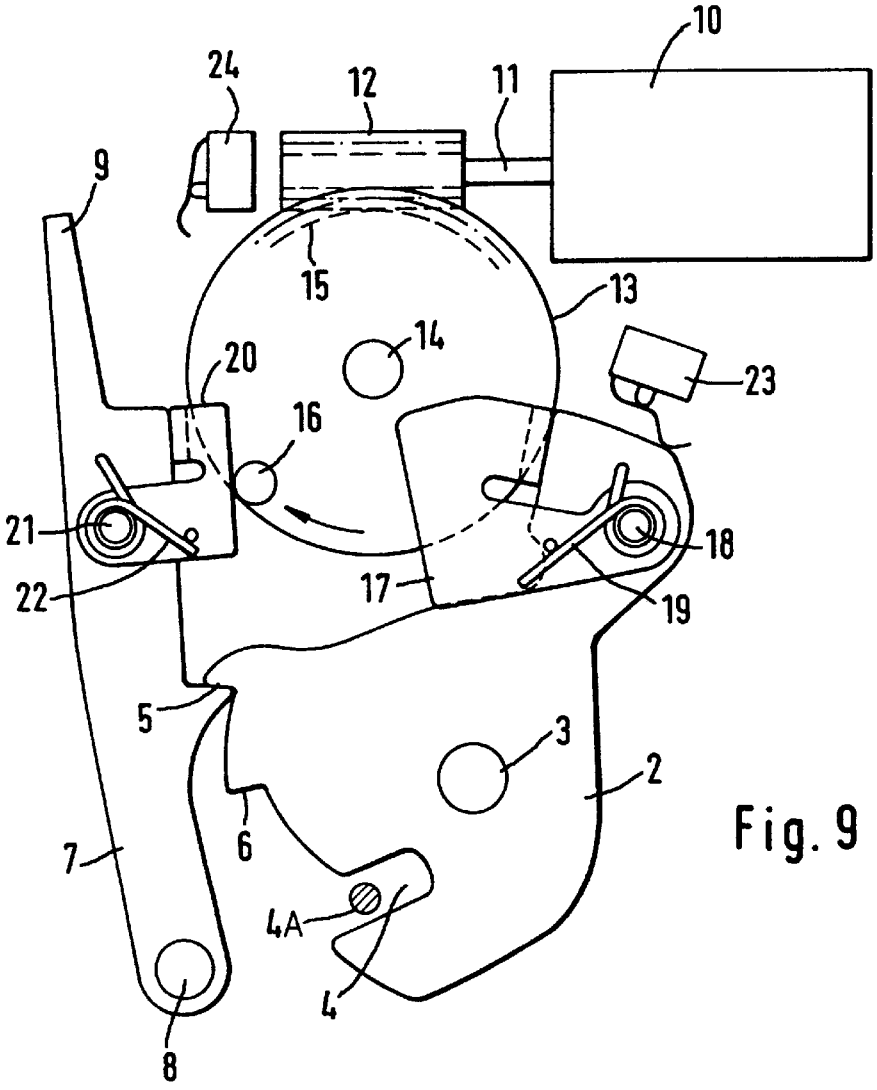

FIG. 9 shows that further rotation in the clockwise direction causes the peg 16 to strike against the pivotable stop element 20 of the detent pawl 7, further rotation of the peg 16 causing the stop element 20 to be further deflected, because of the positively locking connection of said stop element 20 to the detent pawl 7, with the result that the projection on the detent pawl 7 is disengaged from the preliminary catch 5 and the rotary latch 2, which in particular is subjected to spring force, can thereby be moved in the opening direction, as a result of which the fastening peg in the recess 4 is released and the door or the like can be opened. Since during this movement the preliminary catch switch 23 is, as before, operated (main-catch switch 24 as before inoperative), the peg 16 is further rotated until it runs onto a block on the rotary latch 2 or the stop elements 17 thereof, which is in turn shown in FIG. 1. Following the opening procedure (opening assistance) just described, the power-assisted closing device 1 is thus prepared for the locking procedure described already from FIG. 1.

As FIGS. 1 to 9 reveal, in the preliminary catch position the detent pawl 7 has a position which deviates from the main catch position.

Figure 10:
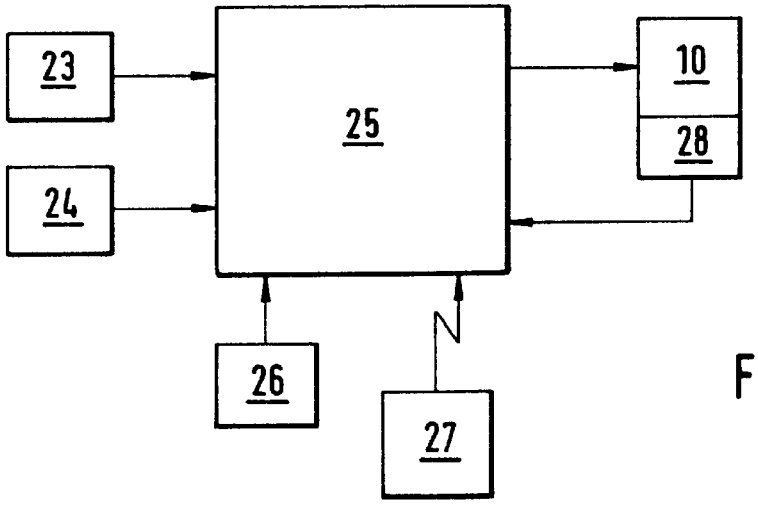
FIG. 10: a control device for activating the actuating drive.

FIG. 10 describes a further control device 25 which controls the sequences of movement which are shown and described in FIGS. 1 to 9. The signals from the preliminary catch switch 23 and the main catch switch 24 are supplied to the control device 25, the control device 25 activating the electric motor 10. The control device 25 furthermore also has an input unit 26 which is integrated in it or is external and by means of which the unlocking procedure (opening assistance) and the locking procedure (shutting assistance) can be triggered by an operator. This input 26 is situated, for example, in the interior of the vehicle and it may, for example, be a switch mounted on a door inside handle so that after the door inside handle is operated, the opening assistance for opening the door is triggered. The control device 25 moreover also has an external input unit in the form of a remote control 27 which can be operated from outside the vehicle. The remote control 27 is, for example, a wireless remote control, so that at the push of a button the unlocking procedure (opening assistance) and/or the locking procedure (shutting assistance) can be triggered. Alternatively or supplementary thereto, it is also possible for a switch or the like to be arranged on the door outside handle so that the unlocking procedure is triggered after the door outside handle is operated. It is inherently understood here that the abovementioned functions proceed in conjunction with further functional positions of the closing device of the vehicle, such as, for example, theft-protection position, central locking position or central unlocking position, and is coordinated with these positions. FIG. 10 also shows that a measuring device 28, is provided on or in the electric motor 10, which device detects a parameter of the electric motor 10 so that the block mode can be controlled by means of the measuring device 28. If, for example, an increased current consumption of the electric motor 10 or else a failure of the voltage supply is ascertained by the measuring device 28, this is a sign that the electric motor 10 has run onto block and the activation can be switched off. For this purpose, the control device 25 correspondingly evaluates the signal output by the measuring device 28. Instead of a measuring device 28 provision can also be made for the electric motor 10 to be activated for a predetermined time for the movement from one rest position into the next rest position, this time being dimensioned in such a manner that the electric motor 10 reliably reaches the next position. If the electric motor 10 then runs in block mode, it remains activated for a short time up until the activation time has elapsed, and it is then switched off.

LIST OF REFERENCE NUMBERS

1. Power-assisted closing device
2. Rotary latch
3. Pivot
4. Recess
5. Preliminary catch
6. Main catch
7. Detent pawl
8. Pivot
9. Extension
10. Electric motor
11. Motor shaft
12. Worm
13. Disk cam
14. Pivot
15. Worm thread
16. Peg
17. Pivotable stop element
18. Pivot
19. Restoring spring
20. Pivotable stop element
21. Pivot
22. Restoring spring
23. Preliminary catch switch
24. Main catch switch
25. Control device
26. Input
27. Remote control
28. Measuring device

I claim:

1. A power-assisted closing device (1) for doors, flaps, folding tops or roofs of vehicles, the closing device having a pivotably mounted rotary latch (2) with a recess (4) for receiving a fastening peg (4A), a detent pawl (7) which releasably locks the rotary latch (2), and an actuating drive which acts via a disk cam (13) on the rotary latch (2) and the detent pawl (7) to effect an opening or closing procedure, wherein a pivotable latch stop element (17) is mounted on the rotary latch (2) and a detent stop element (20) is mounted pivotably on the detent pawl (7), one of the latch stop element and the detent stop element interacting with the disk cam (13) in the opening or closing procedure; and wherein the rotary latch (2) has a preliminary catch (5) which interacts with the detent pawl (7) and a main catch (6), means being provided which detect at least the preliminary catch position of the rotary latch (2).

2. The power-assisted closing device (1) as claimed in claim 1, wherein a restoring spring (19,22) is assigned to a respective stop element (17,20).

3. The power-assisted closing device (1) as claimed in claim 1, wherein the disk cam (13) has a peg (16) which acts on the stop elements (17, 20).

4. The power-assisted closing device (1) as claimed in claim 1, wherein the rotary latch (2) can be driven in a geared-down manner by the actuating drive.

5. The power-assisted closing device (1) as claimed in claim 4, wherein the actuating drive is an electric motor (10) which drives the disk cam (13) in a geared-down manner.

6. The power-assisted closing device (1) as claimed in claim 1, wherein for the locking procedure the actuating drive acts via the disk cam (13) on the latch stop element (17) of the rotary latch (2) and for the unlocking procedure on the detent stop element (20) of the detent pawl (7).

7. The power-assisted closing device (1) as claimed in claim 1, wherein the detection means comprise a preliminary catch switch (23) which can be operated by the rotary latch (2) or the latch stop element (17).

8. The power assisted closing device as claimed in claim 7, wherein the detection means further comprises a main-catch switch (24) operated by the detent pawl (7).

9. The power-assisted closing device (1) as claimed in claim 1, wherein the pivotably mounted detent pawl (7) is pretensioned in the direction of the rotary latch (2) and the disk cam (13) by being subjected to force.

10. The power-assisted closing device (1) as claimed in claim 1, wherein the actuating drive is actuatable in order to drive the disk cam (13) which acts as a mechanical switch for selectively operating the detent stop element (20) on the detent pawl (7) to effect an unlocking of the rotary latch (2), and for selectively operating the latch stop element (17) on the rotary latch (2) to accomplish a locking of the closing device.

11. The power-assisted closing device (1) as claimed in claim 10, wherein, upon rotation of the disk cam (13), the disk cam urges the peg (16) against respective ones of the latch and the detent stop elements to urge the stop elements (17, 20) individually radially outward from the disk cam.

12. The power-assisted closing device (1) as claimed in claim 1, wherein the vehicles are passenger cars.

* * * * *